US005911498A

United States Patent [19]

Shemitz et al.

[11] Patent Number: 5,911,498

[45] **Date of Patent: *Jun. 15, 1999**

[54] LUMINAIRE

[75] Inventors: Sylvan R. Shemitz; David B. Miller; Gregory L. Moler, all of Woodbridge, Conn.

[73] Assignee: Sylvan R. Shemitz Designs, Inc., West Haven, Conn.

[ * ] Notice: This patent is subject to a terminal disclaimer.

[21] Appl. No.: 08/761,568

[22] Filed: Dec. 6, 1996

Related U.S. Application Data

[63] Continuation-in-part of application No. 08/623,108, Mar. 28, 1990, Pat. No. 5,676,458.

[51] Int. Cl.[6] ..... F21S 3/00

[52] U.S. Cl. ..... 362/217; 362/223; 362/371; 362/322; 362/359

[58] Field of Search ..... 362/371, 223, 362/322, 359, 217

[56] References Cited

U.S. PATENT DOCUMENTS

| | | | |
|---|---|---|---|
| D. 308,114 | 5/1990 | Shemitz | D26/85 |
| D. 308,260 | 5/1990 | Shemitz | D26/85 |
| D. 312,886 | 12/1990 | Brown | D26/63 |
| D. 349,173 | 7/1994 | Fellinger | D26/85 |
| D. 356,876 | 3/1995 | Waldmann | D26/107 |
| D. 360,049 | 7/1995 | Shemitz | D26/74 |
| D. 360,270 | 7/1995 | Shemitz | D26/74 |
| D. 362,314 | 9/1995 | Shemitz | D26/74 |
| D. 366,536 | 1/1996 | Shemitz | D26/88 |
| 3,774,024 | 11/1973 | Deaton | 240/78 |
| 4,173,034 | 10/1979 | Shemitz | 362/127 |
| 4,556,933 | 12/1985 | Mendoza | 362/267 |
| 4,747,025 | 5/1988 | Barton | 362/147 |
| 4,796,169 | 1/1989 | Shemitz | 362/282 |
| 5,061,872 | 10/1991 | Kulka | 313/111 |
| 5,301,456 | 4/1994 | Jobin | 43/113 |
| 5,381,321 | 1/1995 | Fearing | 362/217 |

OTHER PUBLICATIONS

Elliptipar, Inc., Drawing No. 100/S/83/D/220, Aug. 3, 1983.

Elliptipar, Inc., Drawing No. 100/S/85/D–358, Jul. 18, 1995 and related photograph.

SPI Lighting, "Semi–Recessed Wall Wash Unit ECR SR/EDR SR 1 and 2", SPI Lighting, Inc., Catalog Insert pp. 392–335 (1992).

Insight Lighting, "5 by 10 Semi Recessed", Insight Lighting 5×10 Taos Series drawing (date unknown).

Insight Lighting, "TAOS SR Interior Architectural Luminaires: Semi–Recessed/Biaxial Fluorescent" data sheet (1995).

Insight Lighting, "TAOS SR Interior Architectural Luminaires: Semi–Recessed/Compact Fluorescent" data sheet (1995).

Insight Lighting, "TAOS SR Interior Architectural Luminaires: Semi–Recessed/Incandescent & HQI" data sheet (1995).

*Primary Examiner*—Sandra O'Shea
*Assistant Examiner*—Marshall Honeyman
*Attorney, Agent, or Firm*—Fish & Neave; Jeffrey H. Ingerman; Garry J. Tuma

[57] ABSTRACT

A cylindrical luminaire is provided whose components align easily, for quicker assembly, despite the lack of intrinsic preferred relative orientation in circular components. Circular end plates affixed in a desired alignment to the end of an elongated reflector have notches for alignment of a part-cylindrical cover and slots or pivotal brackets to receive a baffle. The reflector, cover and baffle are accordingly assembled in proper alignment. The baffle can be an optical baffle to alter the aesthetic appearance of the luminaire.

21 Claims, 8 Drawing Sheets

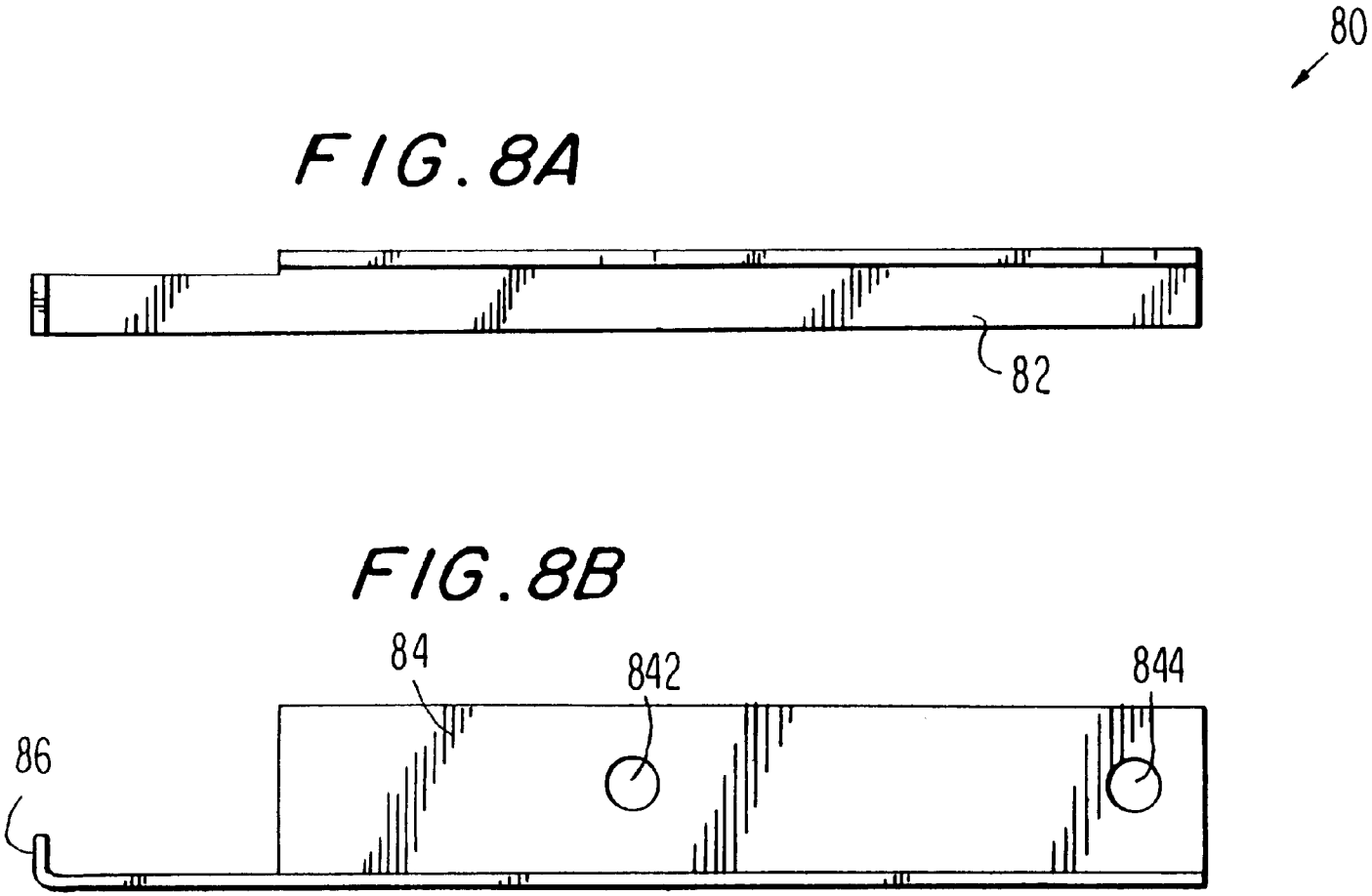
FIG. 8A
FIG. 8B
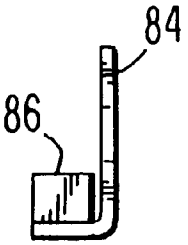
FIG. 8C

LUMINAIRE

CROSS REFERENCE TO RELATED APPLICATION

This is a continuation-in-part of commonly assigned U.S. patent application Ser. No. 08/623,108, filed Mar. 28, 1996, now U.S. Pat. No. 5,676,458.

BACKGROUND OF THE INVENTION

This invention relates to luminaires. More particularly, this invention relates to an elongated cylindrical luminaire having a construction that simplifies and shortens the assembly process.

Elongated luminaires, such as those used with fluorescent tubes or other elongated light sources, are well known. Such luminaires frequently have elongated reflectors in which the light sources are mounted for optimum utilization of the output of the light source. However, a reflector which gives the optimum light output for a particular application may not have an aesthetically pleasing external appearance for that application. Therefore, it is well known in such luminaires to conceal the reflector in a decorative housing.

For example, it is known to provide a luminaire in which the reflector is concealed in a part-cylindrical outer cover. That is, the outer cover is a cylindrical surface extending circumferentially less than 360°, as though it were the surface of a cylinder from which a sector had been removed. The ends of the cylinder are closed with circular end caps. In such a luminaire, the output opening of the reflector typically occupies only a portion of the opening in the cylinder, with the remainder of the opening covered by a baffle. Proper alignment of the reflector and the baffle with the opening is important. However, because the cylinder and the end caps are circular, having no inherently preferred relative orientation, proper assembly of such a luminaire may be difficult and time-consuming.

It would be desirable to be able to provide a cylindrical luminaire which can be easily and quickly assembled with all of its components in proper orientation.

SUMMARY OF THE INVENTION

It is an object of this invention to provide a cylindrical luminaire which can be easily and quickly assembled with all of its components in proper orientation.

In accordance with this invention, there is provided a luminaire with an elongated reflector. The reflector has first and second reflector ends, a reflector longitudinal axis extending between the first and second reflector ends, a length along the reflector longitudinal axis, a plurality of fastener receiving ports at each of the first and second reflector ends, a reflector opening through which light is emitted, and first and second reflector edges bounding the reflector opening.

A light transmissive outer part-cylindrical cover is disposed about the elongated reflector. The cover has first and second cover ends, a cover longitudinal axis which is substantially parallel to the fixture longitudinal axis, a cover radius, and a cover length along the cover longitudinal axis which is greater than the reflector length, such that the first and second cover ends are beyond the first and second reflector ends, respectively.

The cover extends circumferentially less than 360°, thereby forming a longitudinally extended cover opening therein, with the reflector opening facing the cover opening. The cover opening is bounded by cover edges in a direction along the cover longitudinal axis, with the first cover edge being substantially adjacent one of the reflector edges. The cover has portions that are thickened radially inwardly toward the cover longitudinal axis at least adjacent the first and second cover ends.

An optical baffle extends in a first direction longitudinally from the first end to the second end, and in a second direction perpendicular to the first direction between the second cover edge and the second reflector edge. The optical baffle has first and second baffle ends adjacent the first and second cover ends.

First and second substantially circular end plates, each having a radius substantially equal to the cover radius, are located substantially adjacent the respective ones of the first and second ends. Each end plate has a plurality of reflector aligners corresponding to, and in alignment with, the plurality of fastener receiving ports, for fastening each end plate to a respective one of the first and second reflector ends through the plurality of fastener receiving ports. Each end plate also has a baffle aligner for receiving a respective one of the baffle ends, and first and second cover aligners for receiving the radially thickened portions of the cover edges.

First and second cylindrical end caps are provided. Each end cap has a substantially circular plate portion disposed parallel and adjacent to a respective one of the end plates and bounded by a cylindrical skirt that fits over the part-cylindrical cover. The substantially circular plate portion has a radius substantially equal to the cover radius.

The fasteners, the fastener holes, the fastener receiving ports, the cover aligners, the radially thickened portions, and the baffle aligners cooperate to maintain a desired alignment among said reflector, the optical baffle and the cover. Easy and rapid assembly of the luminaire, as well as maintenance of proper alignment of the components during handling, are thereby facilitated.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIGS. 8A, 8B, and 8C are plan, front and side views, respectively, of a baffle bracket of the luminaire of FIG. 7.

DETAILED DESCRIPTION OF THE INVENTION

Figure 1:
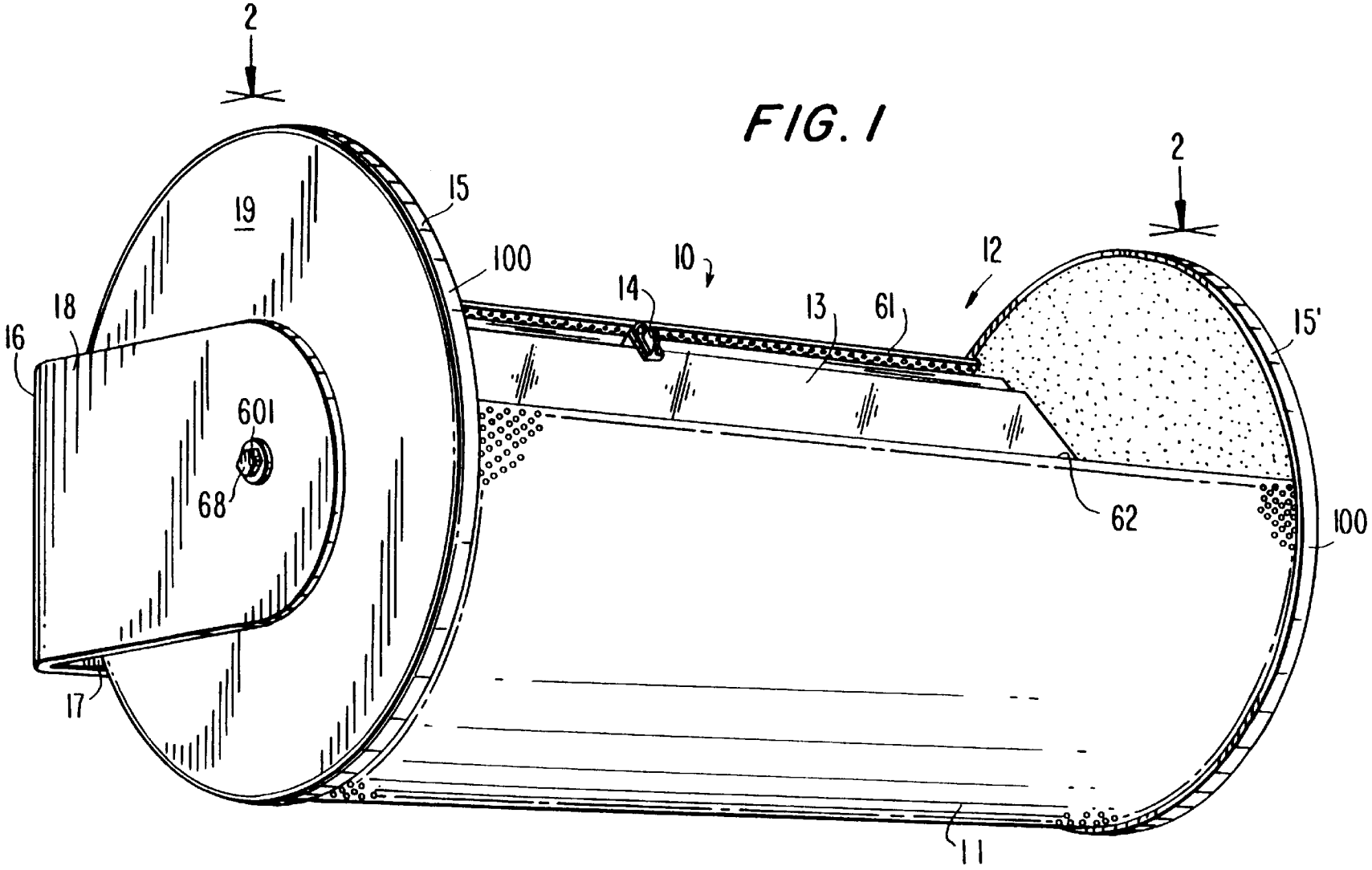
FIG. 1 is a perspective view of a first preferred embodiment of a cylindrical luminaire according to the present invention.
Figure 2:
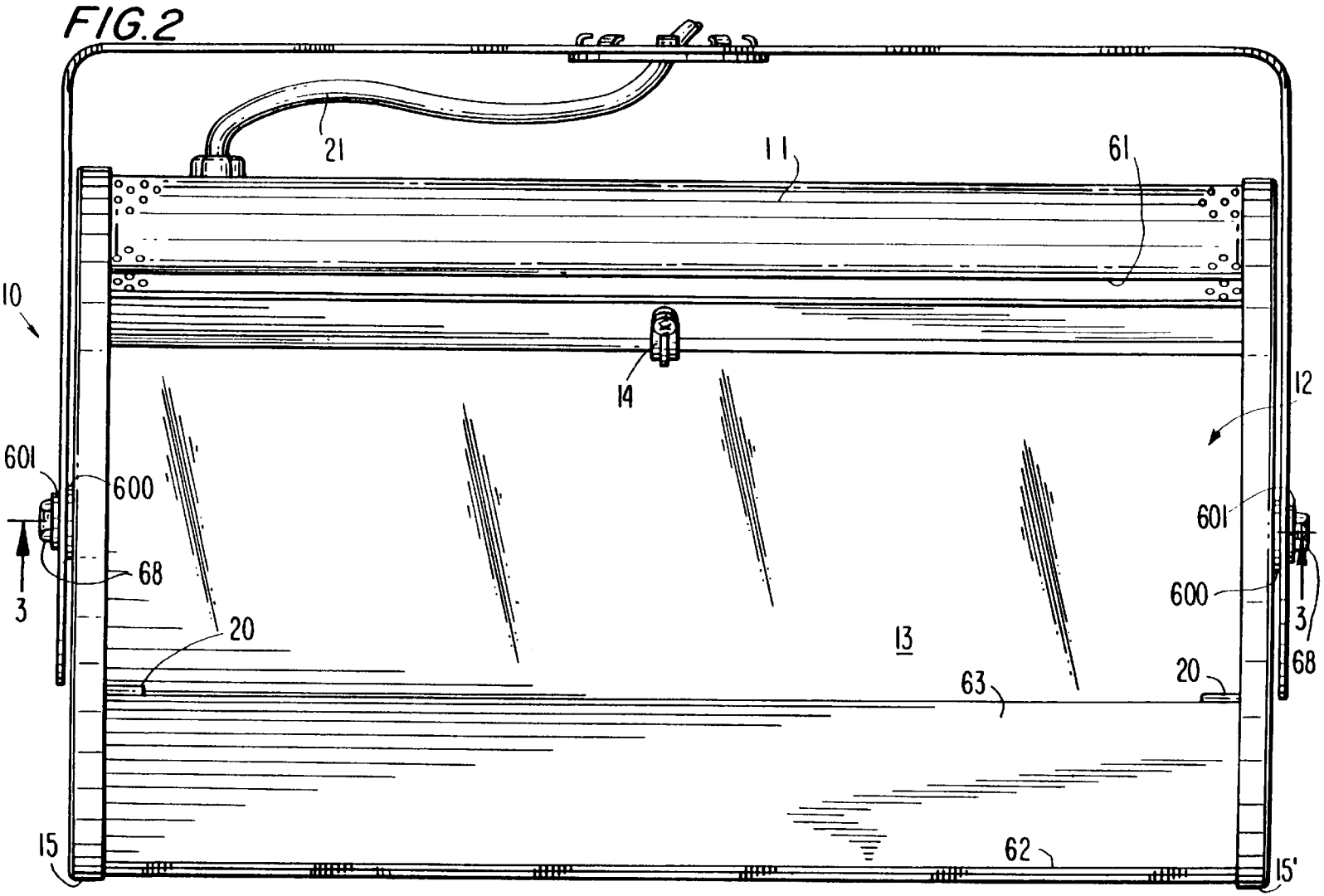
FIG. 2 is a plan view of the luminaire of FIG. 1, taken from line 2—2 of FIG. 1.
Figure 3:
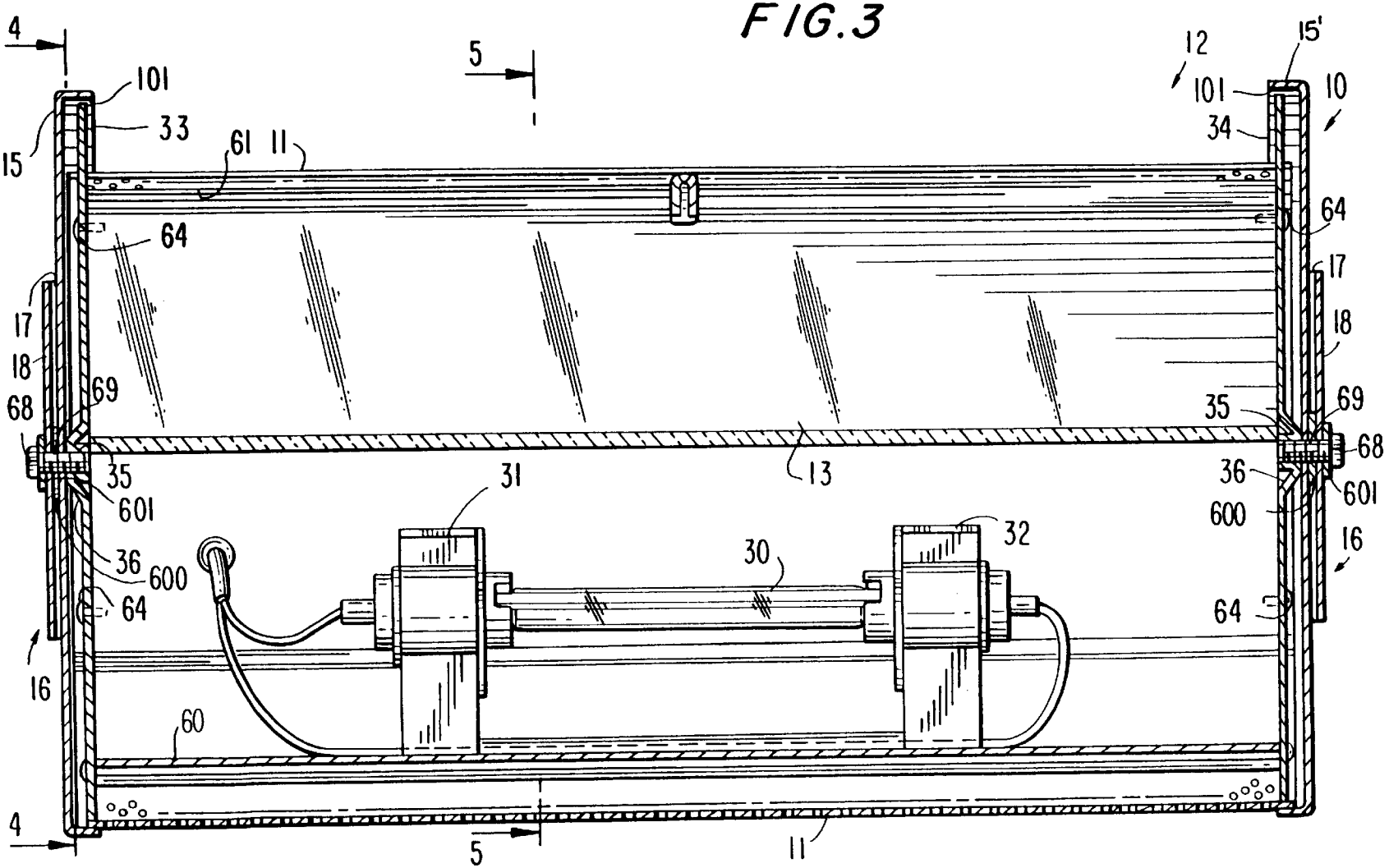
FIG. 3 is a longitudinal cross-sectional view of the luminaire of FIGS. 1 and 2, taken from line 3—3 of FIG. 2.
Figure 4:
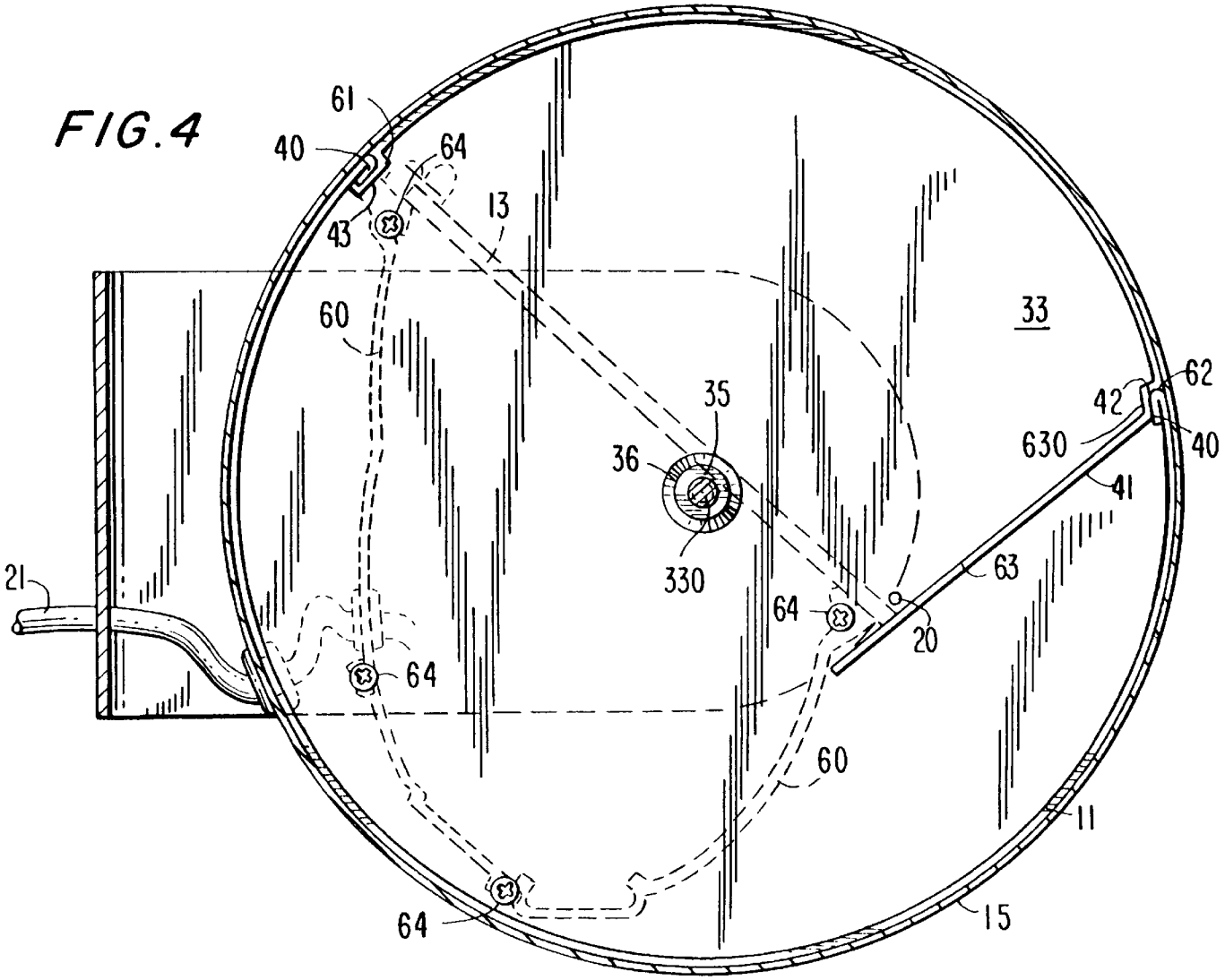
FIG. 4 is a radial cross-sectional view of the luminaire of FIGS. 1–3, taken from line 4—4 of FIG. 3.
Figure 5:
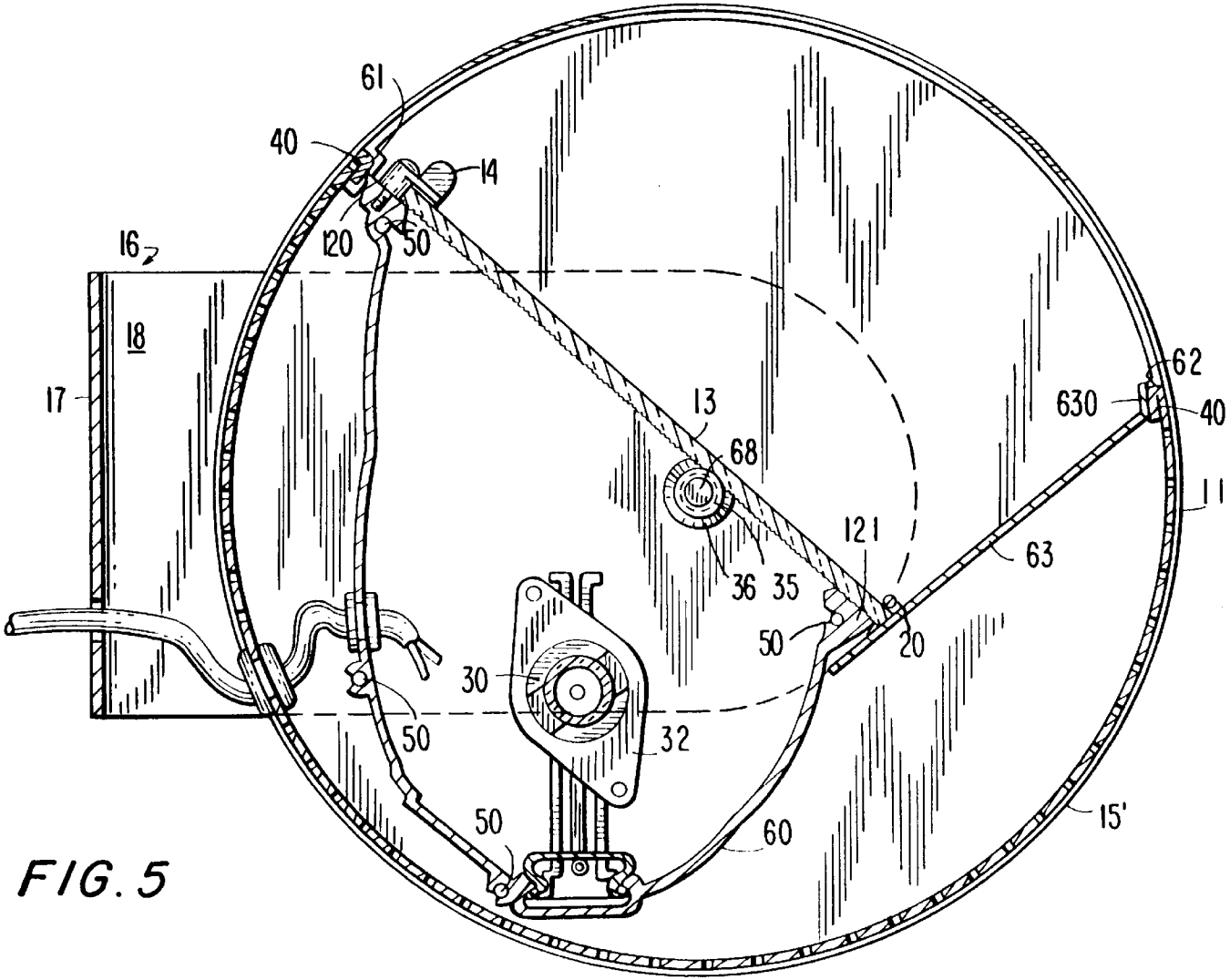
FIG. 5 is a radial cross-sectional view of the luminaire of FIGS. 1–4, taken from line 5—5 of FIG. 3.
Figure 6:
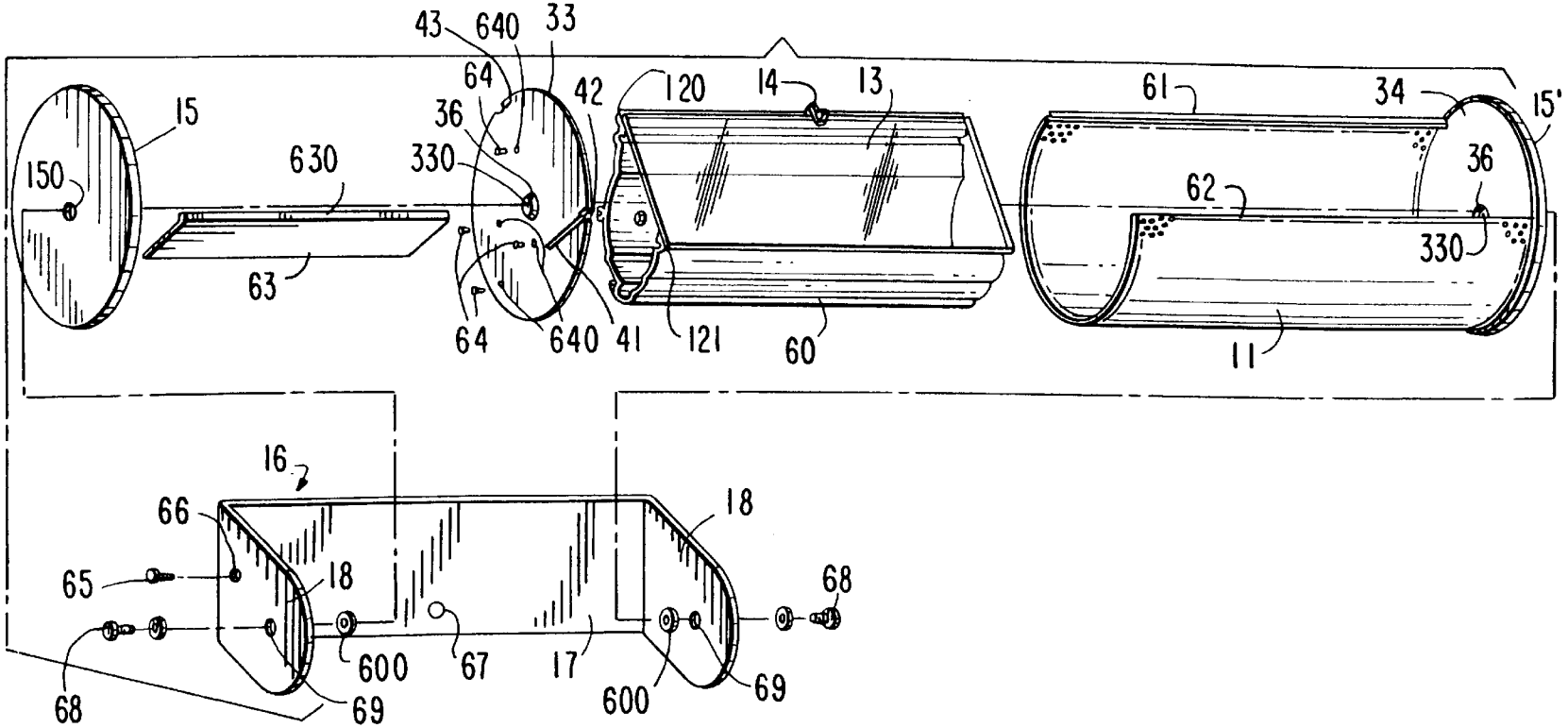
FIG. 6 is an exploded perspective view of the luminaire of FIGS. 1–5.

The cylindrical luminaire according to the present invention includes alignment structures on the various parts from which it is assembled. Accordingly, even though many of the components are circular, they still have a preferred relative orientation. This facilitates assembly, resulting in a decrease in assembly time (and concomitantly in assembly cost), and also provides a more consistent, better aligned product.

A first preferred embodiment of a luminaire 10 according to the invention is shown in FIGS. 1–6.

Luminaire 10 is preferably substantially cylindrical, preferably having an outer part-cylindrical cover 11 surrounding an elongated reflector 60. A particularly preferred reflector is the ELLIPTIPAR® reflector available from the Elliptipar division of Sylvan R. Shemitz Designs, Inc., of West Haven, Conn. Reflector 60 preferably houses a light source 30, supported in reflector 60 by one or more lampholders 31, 32. Light source 30 is preferably a point or line source, but other light sources, including but not limited to tungsten-halogen lamps, linear fluorescent lamps, compact fluorescent lamps, or larger diameter luminous sources may be used.

Part-cylindrical outer cover 11 is preferably a surface such as would be obtained on the surface of a cylindrical solid if a sector were removed from the cylindrical solid. Cover 11 thus extends circumferentially for less than 360°, leaving an opening 12 that reveals reflector 60 and light source 30. The longitudinal edges 61, 62 of cover 11 that bound opening 12 are preferably rolled over to form smooth edges, and preferably resulting in thickened portions 40.

A portion of opening 12 preferably is filled by reflector 60, one edge 120 of which is preferably adjacent edge 61 of cover 11. The remainder of opening 12 is covered by a baffle 63, which preferably extends from edge 62 of cover 11 to the other edge 121 of reflector 60. In the first embodiment shown, baffle 63 does not meet edge 121 of reflector 60 at the longitudinal axis of cover 11. Thus, even though the surface of cover 11 can be defined by a cylindrical solid from which a cylindrical sector has been removed, the solid portion actually missing from the cylinder whose surface defines cover 11 is not actually a sector. However, in other embodiments (not shown), it may be possible for edge 121 of reflector 60 to meet baffle 63 at or near the longitudinal axis, in which case the solid portion missing from the cylinder would be substantially a sector.

First and second end plates 33, 34 preferably are affixed to the longitudinal ends of reflector 60, preferably by screws 64 passing through holes 640 in end plate 33, 34 into fastener ports 50 in reflector 60. End plates 33, 34 and edges 120, 121 of reflector 60 together preferably form a substantially rectangular opening through which light exits reflector 60. That opening is preferably covered with a light transmissive plate or lens 13, which preferably is held in place by a releasable latch 14 preferably mounted on edge 120 of reflector 60, and by a respective pin 20, one of which extends longitudinally from each end plate 33, 34. Each pin 20 captures lens 13 against edge 121 of reflector 60 and against baffle 63. Other possible mountings can be used for lens 13, including a gasketed door with screw fasteners. Alternatively, depending on the type of light source used, lens 13 could be omitted.

The outer side of each end plate 33, 34 is preferably covered by an end cap 15, 15', which hides the fasteners and other elements (see below) affixed to or protruding from end plates 33, 34, forming a smooth, aesthetically pleasing outer surface. A bracket 16, preferably having a base 17 and a pair of substantially parallel arms 18, preferably is affixed to both ends of the cylinder formed by cover 11 and end caps 15, 15', and is used to mount luminaire 10 to a wall or other mounting surface. An electrical cable 21 connected to light source 30 exits through reflector 60 and cover 11 and preferably passes through a hole 67 in base 17 for connection to a power source (not shown) in the wall or other mounting surface.

Preferably, the cylindrical body of luminaire 10 is pivotable about its longitudinal axis relative to bracket 16, but is preferably restrained from pivoting once mounted by a set screw 65 passing through a hole 66 in one of arms 18 and tightened against end cap 15 after installation to function as a brake against pivoting. Hole 66 may be provided tapped, or set screw 65 could be self-tapping, in which case hole 66 becomes tapped as soon as set screw 65 is inserted.

End plates 33, 34 preferably provide alignment of reflector 60, cover 11 and baffle 63. As already described, end plates 33, 34 preferably are affixed to reflector 60 by screws 64 passing through holes 640 in end plates 33, 34 into fastener receiving ports 50 of reflector 60. The alignment of end plates 33, 34 with reflector 60 is thus substantially assured. The alignment of reflector 60 with baffle 63 is similarly assured by the provision in each of end plates 33, 34 of a respective slot 41 into which baffle 63 is inserted. A preferably upturned end 630 of baffle 63 preferably rests in a respective notch 42, communicating with slot 41, in each end plate 33, 34.

Notch 42 is preferably deep enough to accept not only upturned end 630 of baffle 63, but also thickened portion 40 of edge 62 of cover 11. A similar notch 43 preferably accepts thickened portion 40 of edge 61 of cover 11. The alignment of cover 11 relative to end plates 33, 34 is thereby also assured.

The cylindrical body is therefore easily assembled in proper alignment by affixing end plates 33, 34 to reflector 60, inserting baffle 63 into slots 41, and covering the assembly with cover 11, whose thickened portions 40 fit into notches 42, 43. Notches 42, 43, cooperating with thickened portions 40, align cover 11 relative to end plates 33, 34. Although thickened portions 40 are shown as being formed from rolled over edges of cover 11, any other type of protrusion may be provided. Similarly, instead of notches 42, 43, any other type of socket may be provided in or on end plate 33, 34.

Preferably, the radius of each end plate 33, 34 between notches 42, 43 where cover 11 rests is smaller than the radius of the remainder of end plate 33, 34 by the thickness of cover 11, so that the assembly of cover 11 onto end plates 33, 34 creates a substantially round structure. This allows end caps 15, 15' to be attached easily, covering screws 64 and the protruding ends of baffle 63.

End caps 15, 15' preferably are affixed to luminaire 10 by bolts 68 (preferably hex-head bolts) that attach the cylindrical body to bracket 16. Thus, each bolt 68 preferably passes through a hole 69 in respective arm 18, then through a hole 150 in end cap 15, 15' and a hole 330 in end plate 33, 34, where it mates with a nut 35 that preferably is formed integrally with end plate 33, 34. A washer 600 preferably is provided between end cap 15, 15' and arm 18, and a washer 601 preferably is provided between arm 18 and the head of bolt 68.

Each end cap 15, 15' includes a substantially circular plate portion 19 and a substantially cylindrical skirt 100. End plates 33, 34 are preferably a darker color, most preferably black, than the remainder of luminaire 10, in order to produce a desired lighting effect. In the portion of luminaire 10 outside the angular extent of cover 11, the inside wall portion 101 of each cylindrical skirt 100 would be visible against the darker end plate 33, 34 if end plate 33, 34 were to lie directly against plate portion 19 of end cap 15, 15'. Therefore, each end plate 33, 34 preferably has a central boss 36 which spaces the surface of end plate 33, 34 sufficiently far from plate portion 19 to at least substantially prevent interior wall portion 101 of cylindrical skirt 100 from being visible. Boss 36 also provides a space in which nut 35 can be provided, without protruding into the interior space of reflector 60. Of course, any other suitable spacer can be provided in place of boss 36.

Figure 7:
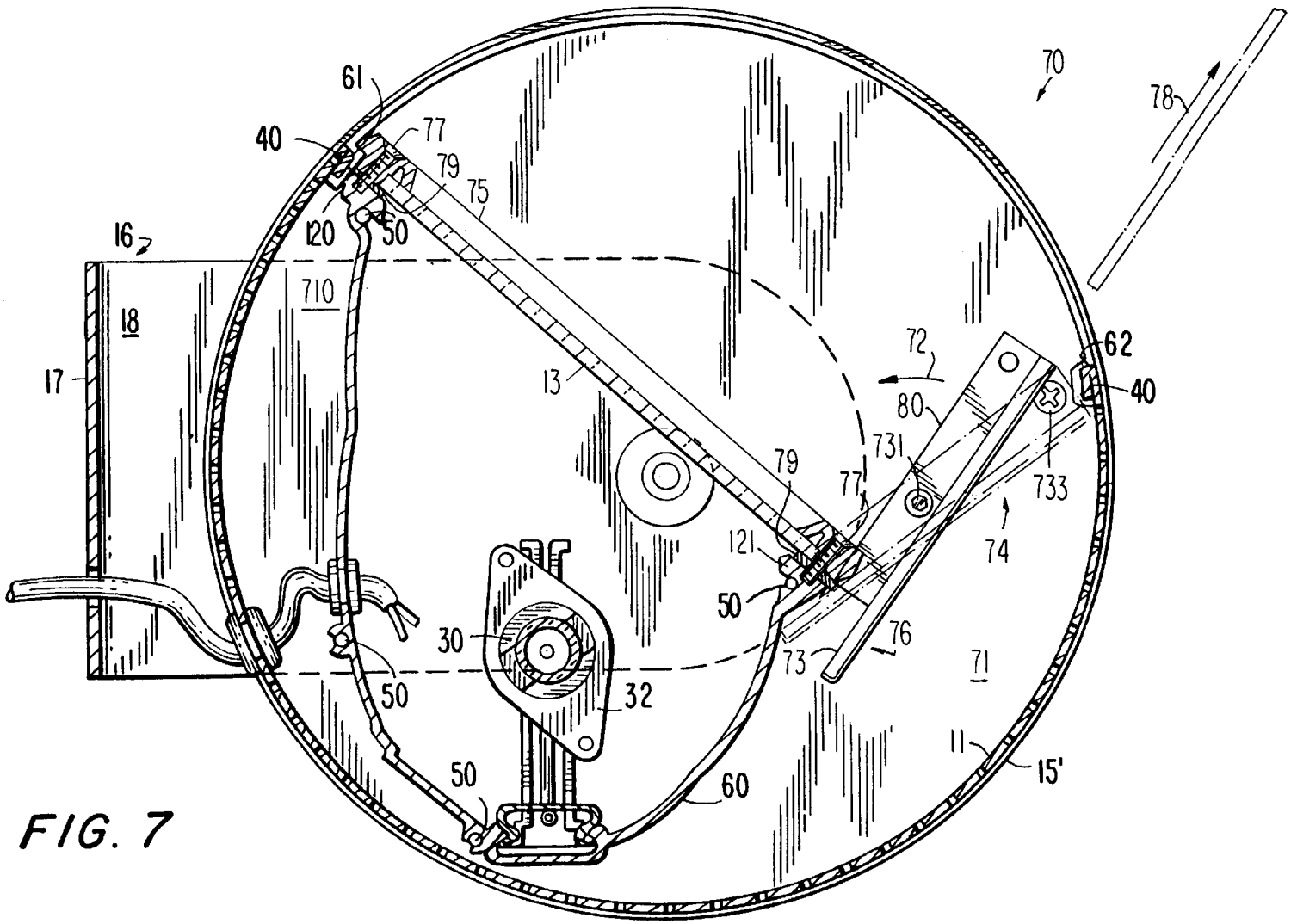
FIG. 7 is a radial cross-sectional view, similar to FIG. 5, of a second preferred embodiment of a luminaire according to the present invention.

In a second preferred embodiment 70 shown in FIG. 7, cover 11 is preferably either perforated, transparent (clear or colored), or translucent (clear or colored), and baffle 63 is preferably replaced by an optical baffle 73. Optical baffle 73 is preferably a transmissive glass or plastic lens having either clear and flat surfaces, a prismatic surface for refracting light, or other surface configurations. Optical baffle 73 can also be used as a diffuser by adding a white or gray additive in the glass or plastic, or by providing sandblasted or etched surfaces. Finally, optical baffle 73 can be used as a color filter by providing a colored additive in the glass or plastic.

Optical baffle 73 intercepts part of the light that has been produced by lamp 30, including light that has been reflected within luminaire 70. Optical baffle 73 may diffusely reflect the light that impinges upon it, causing the baffle to appear to glow if viewed directly. If optical baffle 73 is transmissive, the light that impinges on optical baffle 73 may also be transmitted through optical baffle 73 into interior cavity 71 of luminaire 70, formed by the interior of cover 11, exterior of reflector 60, and optical baffle 73. The light passing through optical baffle 73 and light that reflects off the exterior of reflector 60 can be seen through cover 11, causing cover 11 to appear to glow. Depending on the reflective nature of the materials used in luminaire 70, all of interior cavity 71 would preferably be illuminated so that substantially all of cover 11 would preferably appear to glow, although portion 710 remote from optical baffle 73 may not glow as brightly as other portions of cover 11. The glowing appearance of the luminaire can be determined by the characteristics of optical baffle 73, such as its color.

Optical baffle 73 is preferably held in place with baffle aligners. In this embodiment, the baffle aligners can be the same slots 41 and notches 42 in end plates 33, 34 that are used in luminaire 10 to hold baffle 63. Alternatively, the baffle aligners can be baffle brackets 80 preferably affixed to end plates 33, 34. Baffle brackets 80 could alternatively be formed integrally with end plates 33, 34, rather than being formed separately and affixed to end plates 33, 34. Baffle brackets 80 could also be used with baffle 63 in luminaire 10, and in that case, upturned end 630 would no longer be required, because baffle 63 would not reach slots 41 and notches 42 of end plates 33, 34.

Baffle brackets 80 are preferably pivotable to facilitate installation and removal of the baffle. This enables, for example, the aesthetic appearance of luminaire 70 to be easily changed by replacing one optical baffle 73 with another. Furthermore, facilitating removal of optical baffle 73 enables it to be easily washed or cleaned and further enables cavity 71 to be easily cleaned by allowing, for example, insertion of a vacuum cleaner nozzle into cavity 71 to remove dust, insects, etc.

As shown in FIGS. 8A–C, baffle bracket 80 is preferably a rigid, generally L-shaped bracket having ledge 82, support member 84, which extends substantially perpendicularly from a first side of ledge 82, and upturned tab 86, which extends substantially perpendicularly from a first end of ledge 82. Support member 84 is adjacent and affixed to a respective end plate. Ledge 82 supports the baffle at a respective baffle end, the respective baffle end being adjacent support member 84. Upturned tab 86 prevents the baffle from sliding inward, while edge 62 of cover 11 prevents the baffle from sliding outward.

A baffle bracket fastener 731, preferably a hex socket head cap screw, mounts baffle bracket 80 to a respective end plate 33, 34 through mount hole 842, which is preferably centered in support member 84, to a corresponding baffle bracket hole (not shown) in end plate 33, 34. The baffle bracket hole may be tapped, or baffle bracket fastener 731 may be a bolt, similar to bolt 68, that passes through hole 842 and the baffle bracket hole where it mates with a nut, similar to nut 35, preferably formed integrally with end plate 33, 34. The mounting of baffle bracket 80 to end plate 33, 34 preferably permits baffle bracket 80 to pivot about baffle bracket fastener 731.

A pivot fastener 733, preferably a Philips pan head screw, secures baffle bracket 80 to the respective end plate 33, 34 through pivot mount hole 844 in support member 84 to a corresponding baffle pivot hole (not shown) in end plate 33, 34. The baffle pivot hole may be tapped, or pivot fastener 733 may be a bolt, similar to bolt 68, that passes through hole 844 and the baffle pivot hole where it mates with a nut, similar to nut 35, preferably formed integrally with end plate 33, 34.

When pivot fastener 733 is installed, baffle bracket 80 is properly aligned in a fixed first baffle position 74 that holds baffle 63 or 73 in place. When pivot fastener 733 is removed, baffle bracket 80 can be pivoted from first position 74 to second baffle position 76, as shown by arrow 72. Once in second position 76, baffle 63 or 73 can be removed by sliding it out in the direction shown by arrow 78. A baffle 63 or 73 can be installed on baffle brackets 80 by sliding it in the direction opposite arrow 78. Baffle brackets 80 can then be pivoted from second position 76 to first position 74, where they can be secured by pivot fasteners 733.

Alignment of reflector 60 with baffle 63 or 73 is still substantially assured by the aligned positioning of baffle brackets 80 on end plates 33, 34.

FIG. 7 also illustrates an alternative mounting for lens 13, briefly mentioned above. Instead of being mounted on edge 120 of reflector 60 with releasable latch 14 and respective pins 20, lens 13 is secured to reflector 60 as part of gasketed door assembly 75. Door assembly 75 is mounted on edges 120, 121 of reflector 60 with screw fasteners 77. A gasket material 79, such as, for example, rubber, surrounds the edges of lens 13 in contact with reflector edges 120, 121. Such a door assembly is preferable when using optical baffle 73, particularly when optical baffle 73 is mounted using baffle brackets 80, because in that case optical baffle 73 cannot be guaranteed to be in place to support the edge of lens 13 as it could in luminaire 10.

Thus it is seen that a cylindrical luminaire which can be easily and quickly assembled with all of its components in proper orientation has been provided. One skilled in the art will appreciate that the present invention can be practiced by other than the described embodiments, which are presented for purposes of illustration and not of limitation, and the present invention is limited only by the claims which follow.

What is claimed is:

1. A luminaire comprising:

(a) an elongated reflector having:

(i) first and second reflector ends, (ii) a reflector longitudinal axis extending between said first and second reflector ends, (iii) a reflector length along said reflector longitudinal axis, (iv) a plurality of fastener receiving ports at each of said first and second reflector ends, (v) a reflector opening through which light is emitted, and (vi) first and second reflector edges bounding said reflector opening; and (b) a light transmissive outer part-cylindrical cover disposed about said elongated reflector, said cover having:

(i) first and second cover ends, (ii) a cover longitudinal axis, said cover longitudinal axis being substantially parallel to said reflector longitudinal axis, (iii) a cover radius, and (iv) a cover length along said cover longitudinal axis, said cover length being greater than said reflector length, such that said first and second cover ends extend beyond said first and second reflector ends, respectively, wherein:

said cover extends circumferentially less than 360°, thereby forming a longitudinally extended cover opening therein, said reflector opening facing said cover opening, said cover opening being bounded by cover edges in a direction along said cover longitudinal axis, said first cover edge being substantially adjacent one of said reflector edges, said cover having portions thickened radially inwardly toward said cover longitudinal axis at least adjacent said first and second cover ends, respectively; said luminaire further comprising:

(c) an optical baffle extending in a first direction longitudinally from said first cover end to said second cover end, said optical baffle extending in a second direction perpendicular to said first direction between said second cover edge and said second reflector edge, said optical baffle having first and second baffle ends adjacent said first and second cover ends;

(d) first and second substantially circular end plates, each of said first and second end plates having a radius substantially equal to said cover radius and being substantially adjacent a respective one of said first and second reflector ends, each said end plate having:

(i) a plurality of reflector aligners corresponding to, and in alignment with, said plurality of fastener receiving ports, fastening each of said first and second end plates to a respective one of said first and second ends of said reflector through said plurality of fastener receiving ports, (ii) a baffle aligner receiving a respective one of said baffle ends, and (iii) first and second cover aligners receiving said radially thickened portions of said cover; and (e) first and second cylindrical end caps, each of said end caps having a substantially circular plate portion disposed parallel and adjacent to a respective one of said end plates and being bounded by a cylindrical skirt that fits over said part-cylindrical cover, said substantially circular plate portion having a radius substantially equal to said cover radius; whereby:

said reflector aligners, said fastener receiving ports, said cover aligners, said radially thickened portions, and said baffle aligners cooperate to maintain a desired alignment among said reflector, said optical baffle and said cover.

2. The luminaire of claim 1 further comprising a light transmissive panel extending from said first reflector edge to said second reflector edge.

3. The luminaire of claim 2 wherein said panel is mounted on said reflector in a gasketed door assembly with screw fasteners.

4. The luminaire of claim 1 wherein said cover is perforated.

5. The luminaire of claim 1 wherein said cover is solid and transparent.

6. The luminaire of claim 1 wherein said cover is solid and translucent.

7. The luminaire of claim 1 wherein said baffle aligner comprises a slot and notch for aligning and holding in place said optical baffle.

8. The luminaire of claim 1 wherein said baffle aligner comprises a baffle bracket for aligning and holding in place said optical baffle.

9. The luminaire of claim 8 wherein said baffle bracket comprises a ledge for supporting said baffle at said respective one of said baffle ends, said ledge having first and second ends and first and second sides, a support member extending substantially perpendicularly from said first side of said ledge for being affixed to a respective one of said end plates, and an upturned tab extending substantially perpendicularly from said first end of said ledge for preventing said baffle from sliding off said baffle bracket in a first direction substantially parallel to said support member, said cover preventing said baffle from sliding off said baffle bracket in a second direction substantially parallel to said support member.

10. The luminaire of claim 8 wherein:

each of said end plates has at least one baffle bracket hole therein; and said baffle bracket has at least one mount hole therein corresponding to and in alignment with said at least one baffle bracket hole, and at least one baffle bracket fastener for affixing said baffle bracket to a respective end plate through said at least one mount and bracket holes.

11. The luminaire of claim 8 wherein said baffle bracket is pivotable to facilitate installation and removal of said baffle.

12. The baffle bracket of claim 11 comprising a pivot mount hole and a pivot fastener, wherein said baffle bracket is mounted to a respective end plate such that said baffle bracket may pivot about said mounting, each of said end plates having a baffle pivot hole corresponding to and in alignment with said pivot mount hole such that when said pivot fastener is installed through said pivot mount hole and said baffle pivot hole, said baffle bracket is in a properly aligned fixed first baffle position for holding said baffle in place, and when said pivot fastener is removed, said baffle bracket is pivotable to a second baffle position for facilitating installation and removal of said baffle.

13. The luminaire of claim 1 wherein said optical baffle is light transmissive.

14. The luminaire of claim 13 wherein said optical baffle is clear.

15. The luminaire of claim 13 wherein said optical baffle is colored.

16. The luminaire of claim 13 wherein said optical baffle is transparent.

17. The luminaire of claim 13 wherein said optical baffle is translucent.

18. A luminaire comprising:

(a) an elongated reflector having:

(i) first and second reflector ends, (ii) a reflector longitudinal axis extending between said first and second reflector ends, (iii) a reflector length along said reflector longitudinal axis, (iv) a plurality of fastener receiving ports at each of said first and second reflector ends, (v) a reflector opening through which light is emitted, and (vi) first and second reflector edges bounding said reflector opening; and (b) an outer part-cylindrical cover disposed about said elongated reflector, said cover having:

(i) first and second cover ends, (ii) a cover longitudinal axis, said cover longitudinal axis being substantially parallel to said reflector longitudinal axis, (iii) a cover radius, and (iv) a cover length along said cover longitudinal axis, said cover length being greater than said reflector length, such that said first and second cover ends extend beyond said first and second reflector ends, respectively, wherein:

said cover extends circumferentially less than 360°, thereby forming a longitudinally extended cover opening therein, said reflector opening facing said cover opening, said cover opening being bounded by cover edges in a direction along said cover longitudinal axis, said first cover edge being substantially adjacent one of said reflector edges, said cover having portions thickened radially inwardly toward said cover longitudinal axis at least adjacent said first and second cover ends, respectively; said luminaire further comprising:

(c) a baffle extending in a first direction longitudinally from said first cover end to said second cover end, said baffle extending in a second direction perpendicular to said first direction between said second cover edge and said second reflector edge, said baffle having first and second baffle ends adjacent said first and second cover ends;

(d) first and second substantially circular end plates, each of said first and second end plates having a radius substantially equal to said cover radius and being substantially adjacent a respective one of said first and second reflector ends, each said end plate having:

(i) a plurality of reflector aligners corresponding to, and in alignment with, said plurality of fastener receiving ports, fastening each of said first and second end plates to a respective one of said first and second ends of said reflector through said plurality of fastener receiving ports, (ii) a baffle bracket receiving a respective one of said baffle ends, and (iii) first and second cover aligners receiving said radially thickened portions of said cover; and (e) first and second cylindrical end caps, each of said end caps having a substantially circular plate portion disposed parallel and adjacent to a respective one of said end plates and being bounded by a cylindrical skirt that fits over said part-cylindrical cover, said substantially circular plate portion having a radius substantially equal to said cover radius; whereby:

said reflector aligners, said fastener receiving ports, said cover aligners, said radially thickened portions, and said baffle brackets cooperate to maintain a desired alignment among said reflector, said baffle and said cover.

19. The luminaire of claim 18 wherein said baffle bracket comprises a ledge for supporting said baffle at said respective one of said baffle ends, said ledge having first and second ends and first and second sides, a support member extending substantially perpendicularly from said first side of said ledge for being affixed to a respective one of said end plates, and an upturned tab extending substantially perpendicularly from said first end of said ledge for preventing said baffle from sliding off said baffle bracket in a first direction substantially parallel to said support member, said cover preventing said baffle from sliding off said baffle bracket in a second direction substantially parallel to said support member.

20. The luminaire of claim 19 wherein:

each of said end plates has at least one baffle bracket hole therein; and said baffle bracket further comprises at least one mount hole therein corresponding to and in alignment with said at least one baffle bracket hole, and at least one baffle bracket fastener for affixing said baffle bracket to a respective end plate through said at least one mount and bracket holes.

21. The luminaire of claim 20 wherein said baffle bracket further comprises a pivot mount hole and a pivot fastener, each of said end plates having a baffle pivot hole corresponding to and in alignment with said pivot mount hole such that when said pivot fastener is installed through said pivot mount hole and said baffle pivot hole, said baffle bracket is in a properly aligned fixed first baffle position for holding said baffle in place, and when said pivot fastener is removed, said baffle bracket is pivotable to a second baffle position for facilitating installation and removal of said baffle.

* * * * *

UNITED STATES PATENT AND TRADEMARK OFFICE

CERTIFICATE OF CORRECTION

PATENT NO. : 5,911,498

DATED : June 15, 1999

INVENTOR(S) : Sylvan R. Shemitz et al.

It is certified that error appears in the above-indentified patent and that said Letters Patent is hereby corrected as shown below:

Item [63],
Cover Page, under RELATED U.S. APPLICATION DATA,

"March 28, 1990" should be --March 28, 1996--.

Signed and Sealed this

Second Day of November, 1999

*Attest:*

*Attesting Officer*

Q. TODD DICKINSON

*Acting Commissioner of Patents and Trademarks*